US005326105A

United States Patent [19]

Fenton, Jr.

[11] Patent Number: 5,326,105

[45] Date of Patent: Jul. 5, 1994

[54] SEA PLANE SOLE FOR A GOLF CLUB

[75] Inventor: Francis A. Fenton, Jr., Sarasota, Fla.

[73] Assignee: Fenton Golf, Inc., Sarasota, Fla.

[21] Appl. No.: 64,634

[22] Filed: May 20, 1993

[51] Int. Cl.[5] ..... A63B 53/04

[52] U.S. Cl. ..... 273/167 A; 273/77 A

[58] Field of Search ..... 273/167 A, 173, 174, 273/172, 169, 167 F, 167 G, 167 H

[56] References Cited

U.S. PATENT DOCUMENTS

| | | | |
|---|---|---|---|
| D. 94,549 | 2/1935 | Jansky | 273/172 |
| 1,541,126 | 6/1925 | Dunn | 273/167 A |
| 2,088,095 | 7/1937 | Sargent et al. . | |
| 3,088,736 | 5/1963 | Mospan . | |
| 3,138,386 | 6/1964 | Onions | 273/174 |
| 3,166,320 | 11/1961 | Onions . | |
| 3,810,631 | 5/1974 | Braly . | |
| 4,000,902 | 1/1977 | Perkins | 273/167 A |
| 4,322,083 | 3/1982 | Imai . | |
| 4,522,405 | 6/1985 | Clawges . | |
| 4,635,941 | 1/1987 | Yoneyama . | |
| 4,850,593 | 7/1989 | Nelson . | |
| 4,854,580 | 8/1989 | Kobayashi . | |
| 4,867,457 | 9/1989 | Lowe | 273/169 |
| 4,919,428 | 4/1990 | Perkins . | |
| 5,004,242 | 4/1991 | Iwanaga et al. . | |
| 5,046,733 | 9/1991 | Antonious . | |
| 5,092,599 | 3/1992 | Okumoto et al. . | |
| 5,240,252 | 8/1993 | Schmidt et al. | 273/174 |

*Primary Examiner*—Vincent Millin
*Assistant Examiner*—Steven B. Wong
*Attorney, Agent, or Firm*—Richard H. Kosakowski

[57] ABSTRACT

A golf club of either an "iron"-type, "wood"-type, or "putter"-type, has a clubhead with a face for striking a golfball. The sole of the clubhead has a contoured surface that extends from a leading edge of the striking face of the clubhead toward a rear portion of the clubhead. The contoured surface has a first portion starting at the leading edge of the striking face that extends a predetermined distance towards the rear portion of the head. This first portion of the contoured surface has a convex camber of a predetermined radius. The contoured surface also has a second portion beginning at the end of the first portion and extending the remaining distance toward the rear portion of the clubhead. The second portion of the contoured surface has a concave camber of a predetermined radius.

19 Claims, 2 Drawing Sheets

SEA PLANE SOLE FOR A GOLF CLUB

BACKGROUND OF THE INVENTION

This invention relates to golf clubs and, more particularly, to a golf club whose clubhead has a sole with a contour, extending from the clubface towards the rear of the clubhead, having both convex and concave portions.

In the art of sole designs for both golf club "woods" and "irons" it is known to provide a sole with a convex camber from heel to toe. A typical value for the radius of the camber is approximately 5–9 inches. The advantage of a cambered sole is that it significantly reduces the amount of sole material that comes in contact with the ground, as compared to a sole that is flat from heel to toe. The cambered sole provides for less resistance of the clubhead to ground drag as the club contacts the ground. It also allows the golfer to keep the clubhead as low to the ground as possible for variations in golf club lie positions (e.g., uphill or downhill lies).

It is also known in the art of sole designs for both types of golf clubs, especially irons, to provide a sole having a convex camber extending from the front striking face toward the rear of the clubhead. That is, the camber is provided along the "width" of the sole. The sole width is defined as the distance from the leading edge of the clubface to the farthest rear portion of the sole, as measured along the ground line. Such convex camber reduces the effective sole width of the club, which has the further benefit of reducing the amount of "turf dig" on the leading edge of the club.

It is known in the art that the narrower the width of the sole, the less the leading edge of the club will raise up off the ground when the golfer rolls the face open (i.e., less "bounce"). "Bounce" is an anti-sole digging feature designed in on some clubs. Bounce is defined to be the angle that the sole makes with the ground line when the front leading edge of the clubhead is higher off the ground than the rear trailing edge of the clubhead. Thus, bounce can be increased by either designing in an increased sole angle, or the golfer can "roll the clubface open" more on a club having a relatively large sole width. In this latter situation, the greater the sole width the more the bounce. However, a smaller amount of bounce lessens the chance that the golfer will "blade" or "scull" the ball (i.e., hit the ball thin) when hitting the ball off the grass. Normally, "bounce" is purposely designed into sand wedges to keep the clubhead from digging deeply into the sand.

It is also known to provide a sand wedge with a sole design that is concave for a large portion of the sole from the front of the clubface to the rear of the clubhead. See, for example, U.S. Pat. No. 3,810,631 to Braly. The patentee therein believes that the sole design of the sand wedge can be used to more easily propel a golfball along a path of desired trajectory and distance. This is due to the improved dynamic stability of the head of the club in the medium (i.e., sand) upon which the ball rests, and because of the minimization of the rate of deceleration of the speed of the clubhead upon entry into and passage through the sand.

Further, it is known to provide a golf club with a complex sole that is both concave and convex in various planes through the sole. See, for example, U.S. Pat. No. 4,850,593 to Nelson. The stated purpose of such design is to improve the aerodynamic performance of the club.

Also, it is known to position the clubhead's center of gravity equal to or lower than the golfball's center of gravity. This increases the likelihood that the resulting golf shot will impart a proper trajectory to the ball and a more solid "feel" to the golfer. To accomplish this positioning of the center of gravity, the mass of the clubhead is distributed farther rearward and placed low to the ground. However, this adds to the amount of sole width on the club, which has all of the attendant problems described hereinbefore, along with the further problem of potentially causing greater interference with the turf by the rear of the clubhead, or better known as "sole slap".

However, heretofore, no known clubhead design has been provided for all the clubs within a set of golf clubs, including woods, irons and putter, that has a sole with a convex portion extending from the front leading edge of the clubface toward the rear of the clubhead, followed by a concave portion extending to the rear of the clubhead.

Accordingly, it is a primary object of the present invention to provide a golf club with a head having a sole that is shaped to reduce the possibility of interference of the sole with the turf by both the leading edge and trailing portion of the clubhead.

It is a general object of the present invention to provide a golf club head with a sole that is relatively more efficient in getting the ball in the air.

It is a further object of the present invention to provide a golf club head with a sole that allows more of the weight of the clubhead to be located in the rear of the clubhead so as to properly position the center of gravity of the clubhead with respect to a golfball.

It is a still further object of the present invention to provide a golf club head with a sole that does not cause the clubface to "roll in" while a golfer addresses the ball.

It is yet another object of the present invention to provide a golf club head with a sole that allows a golfer to lay the clubhead more open, if desired, to effectively produce a greater loft angle of the clubface without a corresponding relatively large increase in the bounce of the club.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented a sole for either an "iron" "wood" or "putter"-type of golf club head In the preferred embodiment, the sole has a novel contour extending across the sole width from the clubface back toward the rear of the clubhead. A first sole portion extends from the clubface back toward the rear of the clubhead and has a convex camber of a first radius. The first sole portion is followed by a second sole portion that extends to the extreme rear of the clubhead and has a concave camber of a second radius. The radius of the front convex camber is generally larger than the radius of the rear concave sole camber, although the opposite may be true.

DETAILED DESCRIPTION OF THE PREFERRED EMBODIMENTS

Figure 1:
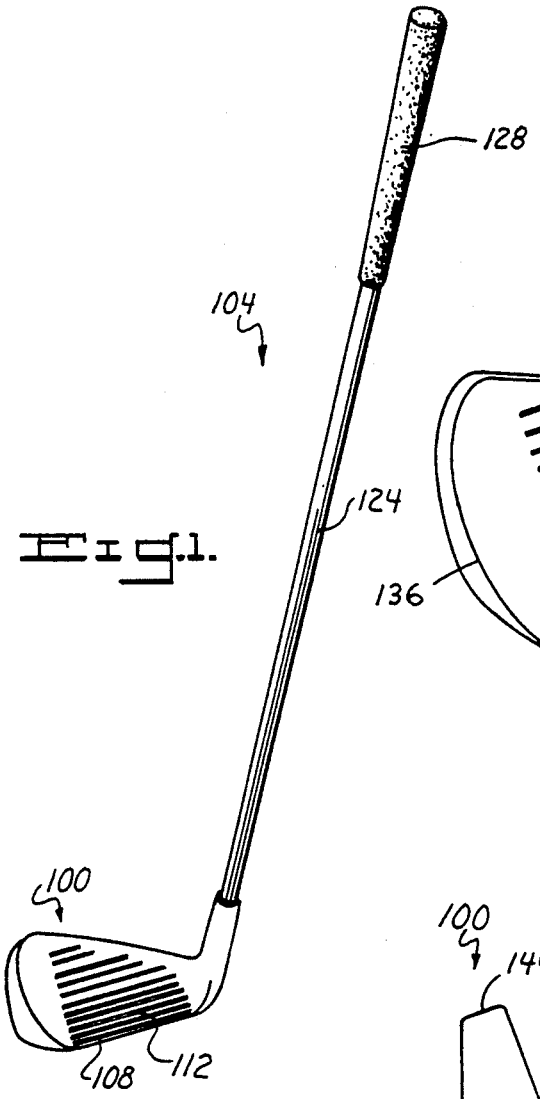
FIG. 1 is a perspective view of a golf club having a clubhead in accordance with the present invention, a shaft and a grip.

Referring to the drawings in detail, a head 100 of either an "iron" "wood", or "putter"-type of golf club 104 has a sole 108 designed in accordance with the present invention, the sole being illustrated and generally designated by the reference number 108. The sole 108 has a contour from the front of the clubface 112 toward the rear of the clubhead 100. A first sole portion 116 extends from the clubface 112 toward the rear of the clubhead 100 and has a convex camber of a first radius, followed by a rear portion 120 with a concave camber of a second radius. The radius of curvature of the front convex portion 116 is generally larger then the radius of curvature of the rear convex portion 120, although the opposite may be true.

Referring to FIG. 1, there illustrated in perspective is an "iron"-type of golf club 104. The club 104 comprises a clubhead 100, having the sole design of the present invention, for striking a ball (not shown), a shaft 124 attached to the clubhead 100, and a grip 128 to facilitate swinging of the club 104 by the player.

Figure 2:
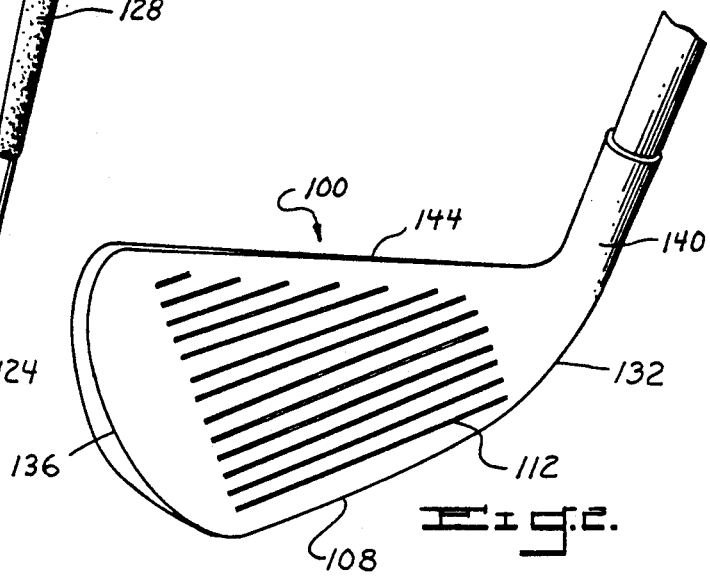
FIG. 2 is a perspective view of the clubhead of FIG. 1.

In FIG. 2 is illustrated in greater detail a perspective view of the clubhead 100 of FIG. 1. The "iron"-type of clubhead 100 is integrally formed as one piece by any one of a number of methods; for example, casting, investment casting, forging, milling, molding, etc. It is to be understood that the manner in which the clubhead 100 is formed has no effect on the present invention. The clubhead 100 typically comprises heel 132 and toe 136 portions. Rising up from the heel 132 portion is a neck 140, or "hosel" having a bore hole formed therein into which a tip of the shaft 124 of FIG. 1 is inserted and secured thereto. The shaft 124 may be secured by any one or more of a number of known methods; including, but not limited to, adhesives and/or transverse pins. The clubhead 100 also comprises a striking face 112 having a plurality of grooves formed therein. The clubhead 100 further includes a top line 144 and a sole 108. The sole 108 may be curved from heel 132 to toe 136 with a radius that typically ranges between 5–9 inches. In the alternative the sole 108 may be flat from heel 132 to toe 136, if desired. The type and amount of curvature, if any, employed on the sole 108 from heel 132 to toe 136 has no effect on the present invention.

Figure 3:
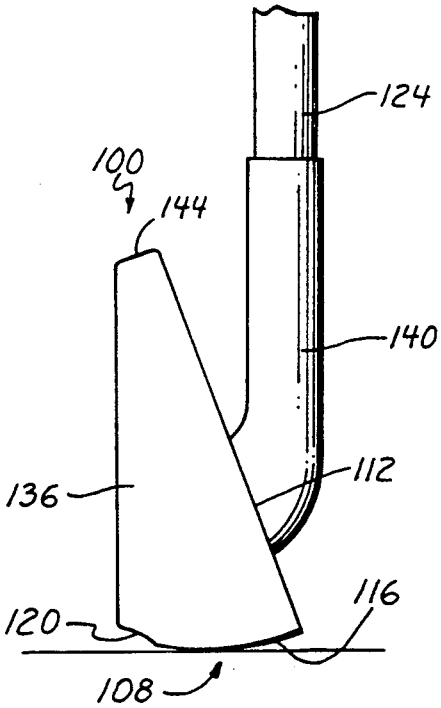
FIG. 3 is a toe-end view of the clubhead of FIG. 2 of one iron within a set of irons, the clubhead having the sole design of the present invention with a front convex camber of a larger radius than the radius of a rear concave camber.

Referring now to FIGS. 3–6, there illustrated are toe-end views of three different "iron"-type clubs 104 within a set of irons. Such views best illustrate the novel sole curvature from the front of the clubface 112 towards the rear of the clubhead 100, in accordance with the present invention. FIG. 3 illustrates a clubhead 100 for a Number 3 iron within the set of irons. Relative to the other irons within the set, the Number 3 iron has a small amount of loft angle, for example, approximately between 20–24 degrees. For irons, loft angle is generally measured as the angle between the center line of the hosel 140 and the plane of the striking face 112 of the clubhead 100.

Figure 4:
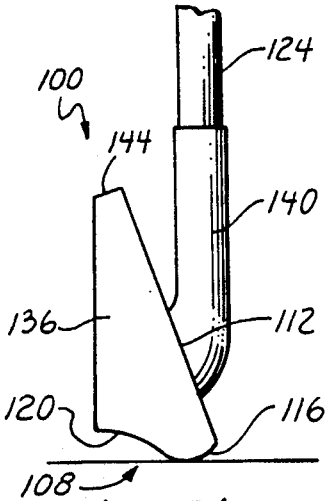
FIG. 4 is a toe-end view of the iron of FIG. 3 with the front convex camber of a smaller radius than the radius of the rear concave camber.

In accordance with the present invention, the sole 108 of the Number 3 iron is curved from front to back; i.e., from the lower leading edge of the clubface 112 toward the trailing edge of the rear of the clubhead 100. Further, the curvature or camber of the sole portion 116 beginning at the leading edge of the clubface 112 is convex and of a predetermined radius. The convex curvature extends for a portion of the overall width of the sole 108. Following the convex camber portion 116 is a concave camber portion 120 of a second predetermined radius. In the preferred embodiment of the present invention, the convex camber portion 116 has a radius of approximately 1.5 inches, while the rear concave camber portion 120 has a radius of 0.5 inches. It is to be understood, however, that such values of radii are purely exemplary; any value of radii may be chosen in light of the teachings herein. As such, FIG. 4 illustrates the Number 3 iron wherein the front convex camber 116 has a radius that is smaller than the radius of the rear concave camber 120. In the alternative, the radius of the front convex camber 116 may equal the radius of the rear concave camber.

Figure 5:
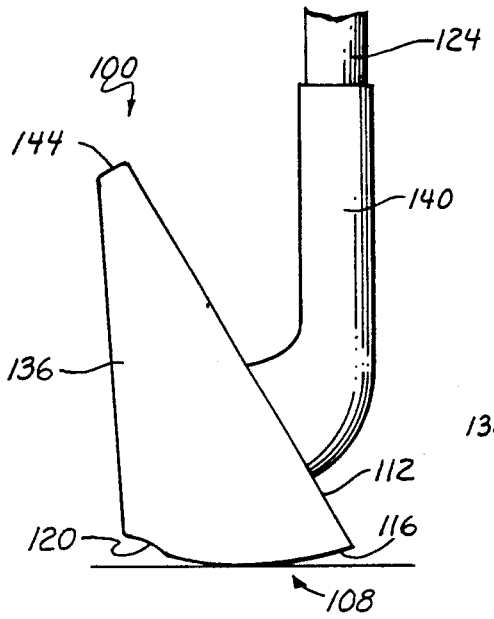
FIG. 5 is a toe-end view of a second iron within the set of irons, the clubhead of the iron having the sole design of the present invention.
Figure 6:
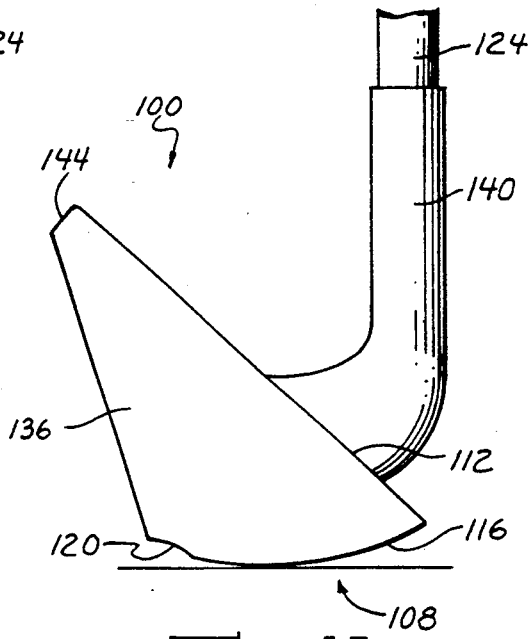
FIG. 6 is a toe-end view of a pitching wedge within the set of irons, the clubhead of the pitching wedge having the sole design of the present invention.

FIGS. 5 and 6, respectively, Illustrate a Number 6 iron and a pitching wedge within the set of irons. For the Number 6 iron, the radius of the front convex camber portion 116 equals 2.0 inches, while the radius of the rear concave camber portion 116 equals 0.75 inches. A typical value for the loft angle of the Number 6 iron is between 30–34 degrees.

For the preferred embodiment of the pitching wedge illustrated in FIG. 6, the front convex camber portion 116 has a radius of 2.5 inches, while the rear concave camber portion 120 has a radius of 1.0 inches. The loft angle on a pitching wedge may be between 48–54 degrees.

The three different irons illustrated in FIGS. 3–6 within the set of irons have been described as having radii that differ in value between the clubs. Specifically, the radius of the front convex camber portion 116 has increased in value as the loft has increased. The radius of the rear concave camber portion 120 has shown a similar relationship. That is, the radii progressively change in value as the clubs increase in loft. It is to be understood, however, that such progressively changing radii characteristic is purely exemplary. If desired, the radii may remain the same for all clubheads 100 within the set of irons. Alternatively, the radii of the front convex camber portions 116 may remain the same, while the radii of the rear concave camber portions 120 may vary, or, just the opposite may be true.

Further, FIGS. 3–6 illustrate that the front convex camber portion 116 comprises a majority of the sole width of the irons illustrated therein. However, it is to be understood that, instead the rear concave camber portion 120 may comprise a majority of the sole width (see FIG. 4), or, the convex and concave camber portions 116, 120 may take up equal portions of the overall sole width of the iron.

FIGS. 3–6 have illustrated merely three irons within a typical set of irons. Normally, however, a typical set of irons comprises irons numbered consecutively from 1–9 in ascending order, and further includes a pitching wedge and a sand wedge. The primary difference between the irons is the amount of loft angle. It is to be understood that, although not illustrated with respect to every iron in the set of irons, the novel sole design of the present invention may be applied to each of the other irons within a set in like manner in light of the teachings herein. It should be further understood that a number of other parameters of the clubhead have not been discussed herein. Such parameters include, for example, face progression, hosel offset, width of top line, etc. It should be understood that such additional parameters are irrelevant to the present invention. That is, the present invention merely concerns itself with the curvature of the sole 108 from the front of the clubface 112 toward the rear of the clubhead 100.

Figure 7:
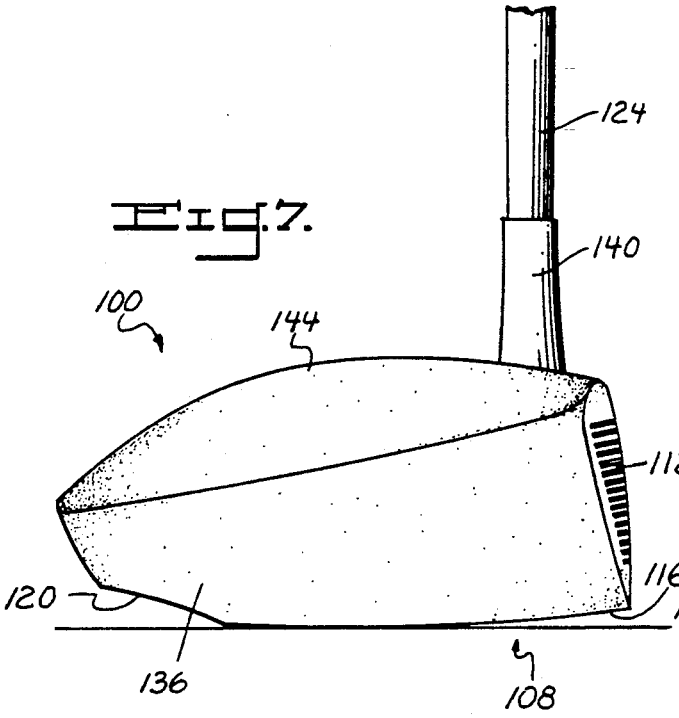
FIG. 7 is a toe-end view of a driver with a clubhead having the sole design of the present invention.

The present invention is not limited to an "iron"-type of clubhead. Referring to FIG. 7, there illustrated is a clubhead 100 of the "wood"-type, which may replace the "iron"-type of clubhead on the golf club 104 of FIG. 1. The clubhead 100 illustrated in FIG 7 may be that of the Number 1 wood, better known as a "driver". In accordance with the present invention, the driver of FIG. 7 has a sole 108 having a portion 116 beginning at the leading edge of the clubface 112 that is of a convex camber, followed by a concave camber portion 120 extending towards the back of the clubhead 100. In a similar manner to the irons described hereinbefore with reference to FIGS. 3–6, the convex camber portion 116 of the driver of FIG. 7 has a radius that typically exceeds that of the concave camber portion 120. Although, as seen in FIG. 4, the convex camber portion 116 may have a radius that is smaller than the radius of the rear concave camber portion 120. In the preferred embodiment, the radius of the front convex camber portion 116 is 14 inches, while the radius of the rear concave camber portion 120 is 5 inches. However, as before, these numbers are purely exemplary; any value of radii of the cambered portions 116, 120 may be chosen without limitation in light of the teachings herein. Also, in a similar manner to the irons described hereinbefore, the convex camber portion 116 may comprise a majority or minority or equal portion of the sole width of the driver clubhead 100.

It is to be understood, however, that all of the foregoing delimiting statements made with respect to the irons of FIGS. 3–6 are equally applicable to the driver of FIG. 6. Further, the driver comprises merely one club 104 within a plurality of "wood"-type clubs within a set of clubs. The driver is typically the wood club having the smallest loft angle, typically between 7–13 degrees. Other woods within a set of woods may be numbered in ascending order with the primary difference therebetween being the amount of loft angle on the clubface 112 of the wood. The progressively changing radii of curvatures of the front and rear cambers among the woods may be similar to the set of irons hereinbefore described.

The "wood"-type of golf club illustrated in FIG. 7 may comprise a head 100 fabricated in a traditional manner from either laminated maple or solid persimmon. Alternatively, the clubhead 100 may comprise the more modern "metal wood"-type of clubhead. The different materials that may comprise the clubhead 100 are irrelevant to the present invention. That is, the present invention is applicable to any type material used for the clubhead 100, including the more elaborate types of alloys commonly employed in modern "metal wood"-types of designs. Regardless of the type of material used for the clubhead 100 of the "wood"-type golf club, it should be apparent to one of ordinary skill in the art how to fabricate the sole 108 of the clubhead with the novel contour according to the present invention.

Figure 8:
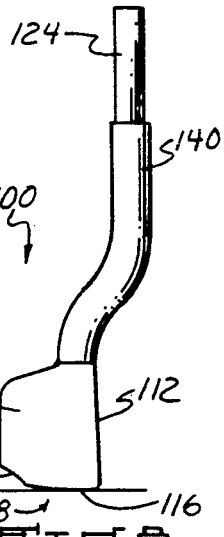
FIG. 8 is a toe-end view of a putter with a clubhead having the sole design of the present invention.

Further, the present invention is equally applicable to a "putter"-type of clubhead. Referring to FIG. 8, there illustrated is a clubhead 100 of the "putter"-type. According to the present invention, the putter of FIG. 8 has a sole 108 with a convex camber portion 116 beginning at the leading edge of the clubface 112. This is followed by a concave camber portion 120 extending towards the back of the clubhead 100. In the preferred embodiment, the radius of the front convex camber portion 116 is 3 inches, while the radius of the rear concave camber portion 120 is 0.5 inches. However, these numbers are purely exemplary. Any values for the radii may be selected such that, if desired, the radius of the rear concave camber portion 120 may, instead, exceed the radius of the front convex camber portion 116. Also, the convex camber portion 116 comprises a majority of the sole width of the putter clubhead 100. However the reverse may be true, similar to FIG. 4, or the portions may be equal. Further, the putter head 100 may be formed in accordance with the present invention using any one of a number of techniques known in the art; for example, forging, milling, molding, casting, etc.

It should be understood by those skilled in the art that obvious structural modifications may be made without departing from the spirit of the invention. Accordingly, reference should be made primarily to the accompanying claims, rather than the foregoing specification, to determine the scope of the invention.

Having thus described the invention, what is claimed is:

1. A head portion of an iron-type golf club, comprising:

a. a striking face on a front portion of the head;

b. a rear portion opposite the front portion;

c. a heel;

d. a toe; and e. a sole having a contoured surface extending from a leading edge of the striking face towards the rear portion of the head, the contoured surface having a first portion beginning at the leading edge of the striking face and extending a predetermined distance toward the rear portion of the head, the first portion of the contoured surface having a convex camber of a predetermined radius, the contoured surface having a second portion beginning at the end of the first portion and extending the remaining distance towards the rear portion of the clubhead, the second portion of the contoured surface having a concave camber of a predetermined radius.

2. The head of claim 1, wherein the radius of the convex camber of the first portion of the contoured surface is greater in value then the radius of the concave camber of the second portion of the contoured surface.

3. The head of claim 1, wherein the radius of the convex camber of the first portion of the contoured surface is smaller in value then the radius of the concave camber of the second portion of the contoured surface.

4. The head of claim 1, wherein the contoured surface of the sole further includes a convex camber extending between the heel and toe of the head.

5. In a set of iron-type golf clubs comprising a plurality of clubs, each club within the set having a shaft and a head portion to which the shaft is attached, the head having a striking face disposed on a front portion of the head, a rear portion opposite the front portion, a heel, a toe, and a sole, wherein the improvement comprises the sole having a contoured surface extending from a leading edge of the striking face toward the rear portion of the head, the contoured surface having a first portion beginning at the leading edge of the striking face and extending a predetermined distance toward the rear portion of the head, the first portion of the contoured surface having a convex camber of a predetermined radius, the contoured surface having a second portion beginning at the end of the first portion and extending the remaining distance toward the rear portion of the clubhead, the second portion of the contoured surface having a concave camber of a predetermined radius.

6. The set of iron-type golf clubs of claim 5, wherein the radius of the convex camber of the first portion of the contoured surface is greater in value then the radius of the concave camber of the second portion of the contoured surface.

7. The set of iron-type golf clubs of claim 5, wherein the radius of the convex camber of the first portion of the contoured surface is smaller in value then the radius of the concave camber of the second portion of the contoured surface.

8. The set of iron-type golf clubs of claim 5, wherein the iron-type golf clubs differ from each other in an amount of loft angle of the striking face.

9. The set of iron-type golf clubs of claim 8, wherein the radius of the convex camber of the first portion of the contoured surface changes in value among the clubs in the set as the loft angle of the striking face of the club increases in value among the clubs in the set.

10. The set of iron-type golf clubs of claim 5, wherein the radius of the convex camber of the first portion of the contoured surface is different for each club within the set of iron-type clubs.

11. The of iron-type golf clubs of claim 5, wherein the contoured surface of the sole further includes a convex camber extending between the heel and toe of the head.

12. An iron-type golf club comprising:

a. a shaft; and b. a head portion having a striking face disposed on a front portion of the head, the head portion also having a rear portion, a heel, a toe, and a sole, the sole having a contoured surface extending from a leading edge of the striking face toward the rear portion of the head, the contoured surface having a first portion beginning at the leading edge of the striking face and extending a predetermined distance towards the rear portion of the head, the first portion of a contoured surface having a convex camber of a predetermined radius, the contoured surface having a second portion beginning at the end of the first portion and extending the remaining distance towards the rear portion of the clubhead, the second portion of the contoured surface having a concave camber of a predetermined radius.

13. The golf club of claim 12, wherein the radius of the convex camber of the first portion of the contoured surface is greater in value then the radius of the concave camber of the second portion of the contoured surface.

14. A head portion of a wood-type golf club, comprising:

a. a striking face on a front portion of the head;

b. a rear portion opposite the front portion;

c. a heel;

d. a toe; and e. a sole having a contoured surface extending from a leading edge of the striking face towards the rear portion of the head, the contoured surface having a first portion beginning at the leading edge of the striking face and extending a predetermined distance toward the rear portion of the head, the first portion of the contoured surface having a convex camber of a predetermined radius, wherein the first portion of the contoured surface comprises means for elevating the leading edge of the striking face above a ground plane when the head is at address and at impact with a golf ball, thereby reducing an amount of physical contact of the sole with the ground plane, the contoured surface having a second portion beginning at the end of the first portion and extending the remaining distance towards the rear portion of the clubhead, the second portion of the contoured surface having a concave camber of a predetermined radius, wherein the second portion of the contoured surface comprises means for elevating the second portion of the contoured surface above the ground plane, at a highest point of the second portion above the ground plane which is higher than the elevation of the leading edge of the striking face above the ground plane, when the head is at address and at impact with the golf ball, thereby reducing an amount of physical contact of the sole with the ground plane.

15. The head of claim 14, wherein the radius of the convex camber of the first portion of the contoured surface is greater in value then the radius of the concave camber of the second portion of the contoured surface.

16. The head of claim 14, wherein the radius of the convex camber of the first portion of the contoured surface is smaller in value then the radius of the concave camber of the second portion of the contoured surface.

17. A head portion of a putter-type golf club, comprising:

a. a striking face on a front portion of the head;

b. a rear portion opposite the front portion;

c. a heel;

d. a toe; and e. a sole having a contoured surface extending from a leading edge of the striking face towards the rear portion of the head, the contoured surface having a first portion beginning at the leading edge of the striking face and extending a predetermined distance toward the rear portion of the head, the first portion of the contoured surface having a convex camber of a predetermined radius, wherein the first portion of the contoured surface comprises means for elevating the leading edge of the striking face above a ground plane when the head is at address and at impact with a golf ball, thereby reducing an amount of physical contact of the sole with the ground plane, the contoured surface having a second portion beginning at the end of the first portion and extending the remaining distance towards the rear portion of the clubhead, the second portion of the contoured surface having a concave camber of a predetermined radius, wherein the second portion of the contoured surface comprises means for elevating the second portion of the contoured surface above the ground plane, at a highest point of the second portion above the ground plane which is higher than the elevation of the leading edge of the striking face above the ground plane, when the head is at address and at impact with the golf ball, thereby reducing an amount of physical contact of the sole with the ground plane.

18. The head of claim 17, wherein the radius of the convex camber of the first portion of the contoured surface is greater in value then the radius of the concave camber of the second portion of the contoured surface.

19. The head of claim 17, wherein the radius of the convex camber of the first portion of the contoured surface is smaller in value then the radius of the concave camber of the second portion of the contoured surface.

* * * * *